United States Patent [19]

Greer et al.

[11] 4,365,741

[45] Dec. 28, 1982

[54] CONTINUOUS CENTRIFUGAL SEPARATION OF COAL FROM SULFUR COMPOUNDS AND MINERAL IMPURITIES

[75] Inventors: Raymond T. Greer, Ames, Iowa; Ronald F. Gibson, Gainesville, Fla.

[73] Assignee: Iowa State University Research Foundation, Inc., Ames, Iowa

[21] Appl. No.: 230,013

[22] Filed: Jan. 30, 1981

[51] Int. Cl.[3] ..... B04B 11/00

[52] U.S. Cl. ..... 494/37; 494/42; 494/65; 494/74

[58] Field of Search ..... 233/16, 19 R, 19 A, 233/21, 27, 28, 34, 38, 40, 41, 22, 1 R, 17, 18, 20 R, 20 A; 209/3.1, 199, 211

[56] References Cited

U.S. PATENT DOCUMENTS

| | | | |
|---|---|---|---|
| 24,714 | 7/1859 | Booth | 106/218 |
| 1,067,766 | 7/1913 | Howard | 233/22 |
| 1,358,375 | 11/1920 | Koch | 209/145 |
| 1,517,509 | 12/1924 | Hokanson | 297/375 |
| 1,613,579 | 1/1927 | Hinchley | 233/19 R |
| 3,799,431 | 3/1974 | Lavanchy | 233/28 |

*Primary Examiner*—Robert W. Jenkins
*Attorney, Agent, or Firm*—Tilton, Fallon, Lungmus

[57] ABSTRACT

A centrifuge method and apparatus particularly useful for desulfurizing slurry coal, and for removing mineral impurities therefrom, so that such coal may be more economically transported in pipeline systems. A slurry of finely-divided coal and impurities is forced upwardly at a predetermined velocity into the chamber of a rotating centrifuge rotor having frusto-conical upper and lower inner surfaces disposed with their apexes meeting along an intermediate apex line. Rotational movement is imparted to the upwardly-directed stream, and coal particles (i.e., particles of lower specific gravity) follow a trajectory leading them into contact with the upper frusto-conical surface, whereas impurities (particles of greater specific gravity) follow a trajectory leading to the lower frusto-conical surface. The respective fractions are directed along such surfaces in opposite axial directions under the influence of centrifugal force, and outlets provided at the upper and lower ends of the rotor allow for the separate discharge of such fractions during continuous operation of the centrifuge.

17 Claims, 3 Drawing Figures

CONTINUOUS CENTRIFUGAL SEPARATION OF COAL FROM SULFUR COMPOUNDS AND MINERAL IMPURITIES

BACKGROUND AND SUMMARY

It has been known in the past that grains, seeds, and other particulate matter composed of particles of different size and/or density may be classified by projecting such material through a suitable nozzle, allowing such particles to follow different trajectories under the influence of gravity, and collecting those particles following different trajectories in different receptacles (U.S. Pat. Nos. 24,714, 1,358,375, 1,517,509). In some instances centrifugal force has been used to project such particles, but gravity has generally been relied upon as the major force for achieving separation and particularly for discharging the particles from the apparatus once separation has been achieved (U.S. Pat. Nos. 1,517,509, 1,358,375, 1,067,766). The equipment disclosed in such early patents has not been known to have achieved significant commercial recognition or acceptance, and is believed totally unsuitable for continuous high-speed separation of particles suspended in an aqueous slurry such as, for example, finely-divided coal to be desulfurized and concentrated so that it may be more economically transported from one area to another through pipelines.

Certain types of mineral matter in coal are detrimental to health (because of toxic trace and minor elements), to boilers (because of corrosion arising from elements such as sodium, chlorine, etc.), and to the environment (sulfur dioxide emissions, acid rains, etc.). The desirability of removing such impurities prior to use of the coal as a fuel is apparent. To avoid the cost of transporting impurities which must later be removed before use of the coal as a fuel, it is believed highly desirable to extract the impurities prior to transporting the material.

This invention is concerned with an effective, high-speed, continuous method and apparatus for separating finely-divided coal from impurities of greater density and, more generally, to a method and apparatus for centrifugally and continuously fractionating a slurry containing particles of similar size but different densities. The apparatus and method are particularly useful for desulfurizing slurry coal, and removing mineral impurities therefrom, so that such coal may be more economically transported in pipeline systems.

The method and apparatus involve the steps of continuously introducing a stream of an aqueous slurry of finely-divided particles having different densities into an axially-disposed inlet at the lower end of a centrifuge chamber while that chamber is rotating about a vertical axis. The chamber has upper and lower frusto-conical surfaces arranged with their apexes facing each other and meeting along an annular horizontal ridge line. Rotational action is imparted to the stream as it passes through the inlet, and the rotational and inflow rates of the stream are controlled so that a first fraction of slurry particles having a density below a selected density level will follow trajectories leading towards the frusto-conical surface above the ridge or apex line, whereas a second fraction of particles having densities greater than the selected density will follow trajectories leading to the frusto-conical surface below that ridge line. Continuous rotation of the chamber causes the lighter and heavier fractions to travel upwardly and downwardly along the respective frusto-conical surfaces. Such lighter and heavier fractions therefore migrate in opposite directions under the influence of centrifugal force and are continuously withdrawn from the upper and lower ends of the chamber while the centrifuge is in operation.

The selected density for differentiating the particles of the two fractions depends on the material to be treated. In the case of coal, such density may be one selected within the range of specific gravities of about 1.4 to 2.0 and, more suitably, 1.5 to 1.7. For optimum separation, the coal and its impurities should be crushed to a size below about 10 microns in diameter. Efficiency of separation is enhanced if such material is crushed to even smaller sizes of the order of 1 to 5 microns in diameter.

For effective and efficient centrifuge operation, the outlet ports at the centrifuge's upper end should be farther from the vertical axis of centrifugation than the outlet ports at the centrifuge's lower end. The result is a substantial balancing of fluid pressures at both sets of ports under given operating speeds. In addition, the horizontal ridge line which constitutes the common apex for both frusto-conical surfaces should be positioned closer to the lower end of the centrifuge rotor than to the upper end thereof, since it has been found that the density bandwidth of the coal-bearing fraction is substantially greater than that of the pyrite-containing fraction.

In the embodiment disclosed, the means for imparting rotational action to the influent stream takes the form of an axial inlet passage that rotates along with the centrifuge rotor, and particularly a plurality of radially-extending vertically-oriented vanes disposed in the lower portion of the rotor and mounted for rotation therewith. Particles and liquid entering the rotor chamber therefore reach angular velocities essentially the same as that of the rotor prior to contact with the frusto-conical surfaces of that rotor.

Other features, objects, and advantages of the invention will become apparent from the specification and drawings.

DRAWINGS

DETAILED DESCRIPTION

Figure 1:
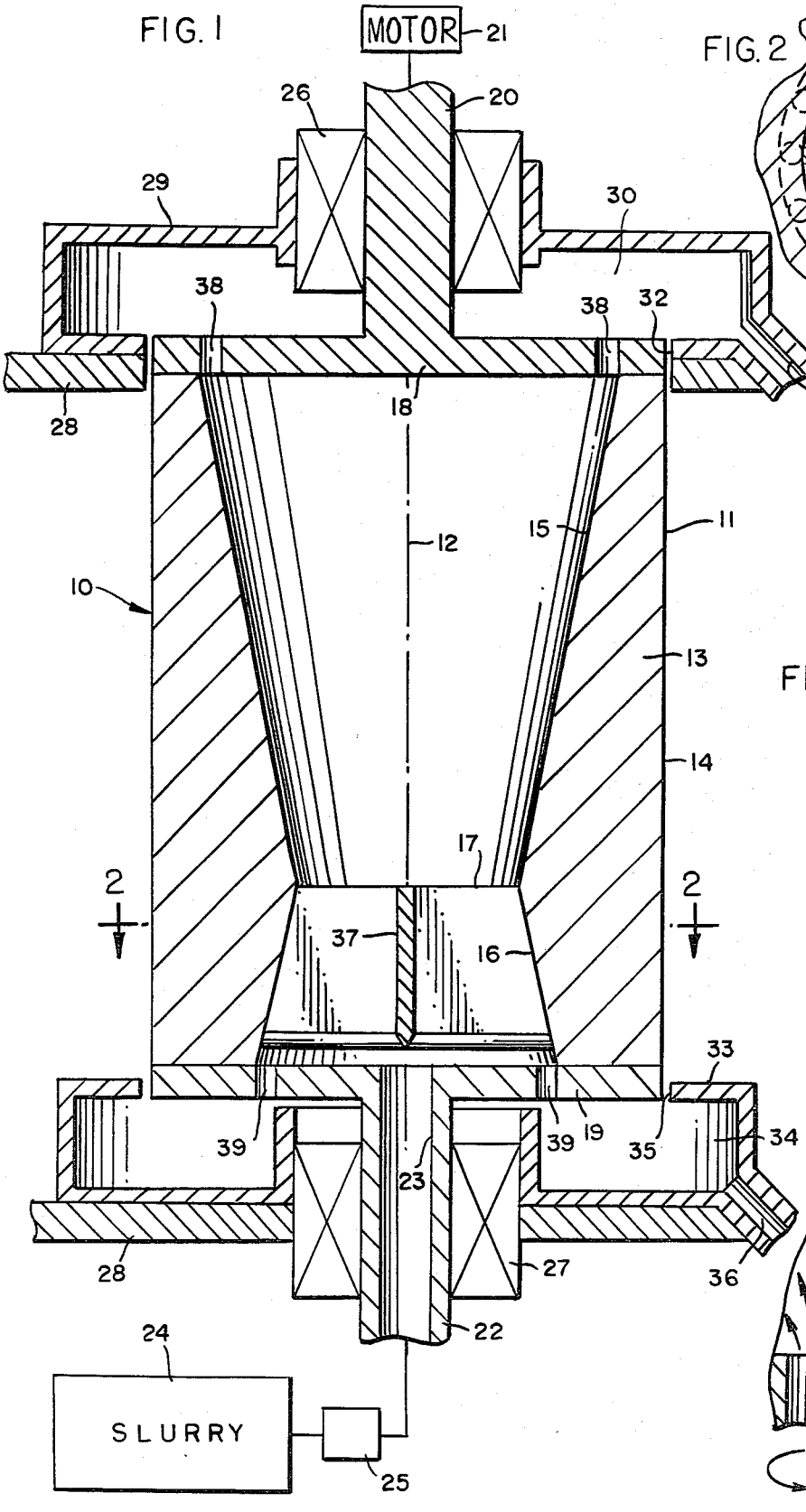
FIG. 1 is a somewhat schematic vertical sectional view of a centrifuge embodying the present invention.

Referring to the drawings, the numeral 10 generally designates a centrifuge having a rotor 11 adapted for rotation about a vertical axis of centrifugation 12. As shown, the rotor has a side wall 13 providing a generally cylindrical outer surface 14 and upper and lower inner surfaces 15 and 16 of frusto-conical configuration. Specifically, the frusto-conical upper surface 15 tapers downwardly and the opposing frusto-conical lower surface 16 tapers upwardly, the two surfaces meeting along an annular horizontal ridge line 17. Line 17 defines the apexes for the two frusto-conical surfaces.

Rotor 11 also includes upper and lower end walls 18 and 19 secured to the upper and lower ends, respectively, of side wall 13. Top wall 18 is secured to, or formed integrally with, an upstanding shaft 20 which is operatively connected to a suitable motor or drive means 21. The bottom wall also includes a depending shaft 22 coaxial with shaft 20 and with the rotor as a whole. It will be observed that lower shaft 22 defines an axial inlet passage 23 for the inflow of a slurry from any suitable source diagrammatically represented in the drawing and designated by numeral 24. Pump 25 delivers the slurry to the centrifuge at a preselected flow rate as hereinafter described.

The rotor is supported by upper and lower bearings 26 and 27 mounted upon a frame 28. An upper annular casing 29 is secured to the frame, supports bearings 26, and defines an annular chamber 30. An outlet 31 for the chamber is provided by the upper casing 29. It will be noted that the casing is provided with an enlarged central opening 32 and that the area of such opening is effectively occupied by the top wall 18 of the rotor.

Similarly, at the lower end of the rotor, mounted upon frame 28, is an annular lower casing 33 defining a chamber 34 having an enlarged central top opening 35 within which the bottom wall 19 of the rotor is rotatably received. An outlet 36 is provided by the lower casing for the discharge of effluent therefrom.

Figure 2:
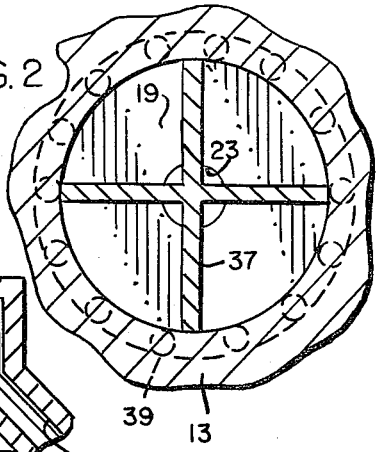
FIG. 2 is a cross sectional view taken along line 2—2 of FIG. 1.

Referring to the rotor construction, FIGS. 1 and 2 reveal that a plurality of vertical vanes 37 radiate outwardly within the lower chamber portion defined by frusto-conical side surface 16 and the top surface of bottom wall 19. The vanes or blades extend laterally to surface 16 and may be secured thereto by any suitable means. In the illustration given, four such vanes or blades are shown; however, a greater or smaller number may be provided. The lower edges of the vanes may be tapered, as depicted in FIG. 1, so that they may effectively direct the slurry flowing into the chamber of the rotor through inlet passage 23 without obstructing that flow.

The upper and lower end walls 18 and 19 of the rotor are each provided with a series of circumferentially-spaced peripheral openings 38 and 39, respectively. Openings 38 are located along the line defined by the convergence of frusto-conical surface 15 with the undersurface of end wall 18, whereas openings 39 are located along the line of meeting between frusto-conical lower surface 16 and the top surface of bottom wall 19. Openings 38 are spaced substantially farther from the axis of centrifugation than openings 39 because, in a rotating body of fluid, the surfaces of constant pressures are paraboloids of revolution due to the interaction of the downward gravitational force and the radially-acting centrifugal force. The discharge openings 38 and 39 of the rotor are therefore located so that the fluid pressure will be the same at both sets of openings during centrifuge operation.

Figure 3:
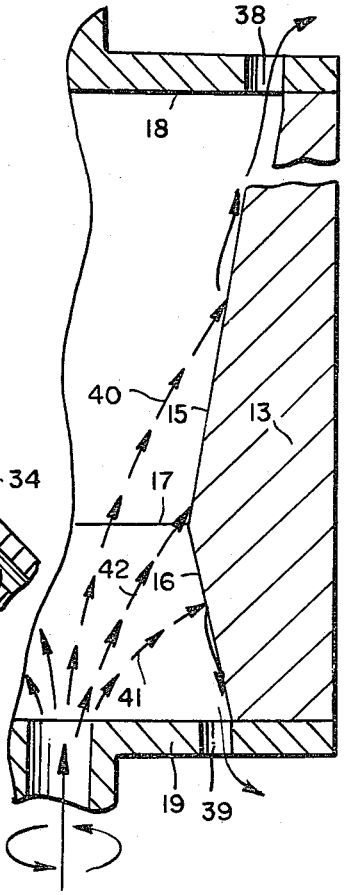
FIG. 3 is a fragmentary sectional view similar to FIG. 1 but omitting certain details of the rotor structure for the purpose of illustrating the various trajectories of particles of different specific gravity during rotor operation.

FIG. 3 is a somewhat schematic view depicting the trajectories of particles of different density or specific gravity during centrifuge operation. Radial vanes 37 are omitted only for clarity of illustration. As slurry is forced upwardly into the rotor chamber through the inlet passage 23, it is also forced to rotate at an angular velocity substantially matching that of the rotor, as already indicated. By controlling the inflow rate by means of pump 25 and coordinating that rate with the speed of rotor 11, slurry particles having a density or specific gravity below a selected level will follow a trajectory that carries them beyond the apex or ridge line 17 of the rotor chamber, as represented by arrows 40 in FIG. 3. Such particles, and the liquid carried with them, impact on frusto-conical surface 15 and are driven upwardly along that surface by centrifugal force, being discharged from the rotor through outlet openings 38 into the stationary collecting chamber 30 of casing 29 (FIG. 1). Similarly, particles having a density or specific gravity substantially exceeding a selected level follow a trajectory represented in FIG. 3 by the line of arrows 41. Such particles and the liquid associated with them impact against the frusto-conical surface 16 below apex line 17 and, under the continuing influence of centrifugal force, flow downwardly and outwardly along that surface until they reach discharge openings 39 and pass into the stationary collecting chamber 34 of casing 33.

Trajectory 42 represents the path of travel of those particles which are at, or just slightly less than, the selected density at which fractionation occurs. In the centrifugal cleaning of fine coal, the slurry inflow rate, and the rotational velocity imparted to that slurry (i.e., the rotational speed of the rotor) are selected so that particles of a density or specific gravity about 1.4 will follow the trajectory represented by arrows 42. Vitrinite has a specific gravity of 1.4, and the other desirable macerals of coal generally have specific gravities less than about 1.6. On the other hand, most of the impurities in coal have specific gravities greater than 1.6; for example, pyrite has a specific gravity of about 5.0. Therefore, if slurry inflow and rotor speed are controlled so that particles having a selected specific gravity within the range of 1.5 to 1.7, or the more general range of 1.4 to 2.0, will travel to the apex line of the rotor chamber, the fraction impacting on the lower frusto-conical surface and driven by centrifugal force into stationary chamber 34 will consist predominantly of pyrite and other impurities, whereas the fraction impinging on the upper frusto-conical surface 15 and directed by centrifugal force into the upper stationary chamber 30 will consist of coal from which a substantial percentage of pyrites and undesirable mineral matter has been extracted.

To illustrate further, the trajectories of two particles of the same size but different specific gravities, introduced into a centrifuge 10 as indicated, will be such that $$\frac{L_{e1}}{L_{e2}} = \frac{\rho_{p2} - \rho_f}{\rho_{p1} - \rho_f}$$

where $L_e$ is the axial distance in inches between the inlet and the points where the respective particles contact the inner surface of the rotor (assuming the radial distance from the centrifugal axis for such points to be equal for both particles), $\rho_p$ is the density of the particle, and $\rho_f$ is the density of the fluid. In the case of coal and pyrite particles of the same size suspended in water $$\frac{(L_e)\ \text{coal}}{(L_e)\ \text{pyrite}} \cong 13$$

Thus, the trajectories of the coal and pyrite particles are different enough to allow physical separation of the two effluent streams from each other, as schematically illustrated in FIG. 3. The trajectory for any given particle may be represented by the following equation $$L_e = \frac{18\, Q\eta \ln\left(\frac{r_o}{r_i}\right)}{AD^2\, \omega^2\, (\rho_p - \rho_f)}$$

where Q is the flow rate of the influent stream in cubic inches per second, $\eta$ is the viscosity of the fluid in $lb_m$/in-sec, $r_i$ is the radial distance in inches of the particle from the axis of the centrifuge at the point of discharge into the rotor chamber, $r_o$ is the radial distance in inches of the particle at the point of contact with the inner surface of the rotor, A is the cross sectional area of the rotor chamber in square inches, D is the diameter of the particle in inches, and $\omega$ is the angular velocity of the rotor in radians per second.

It is believed evident that the effectiveness of the method and apparatus also depends on the coal (or other material to be so fractionated) being finely-divided and of generally uniform particle size or, in any event, of a known range of sizes. In general, the particles suspended in the slurry should be less than 100 microns in size (greater than about 145 mesh), with sizes less than 74 microns (greater than 200 mesh) being preferred. Since coal is commonly crushed to particle sizes smaller than 200 mesh prior to combustion, it is believed apparent that the method and apparatus disclosed herein may be conveniently used in association with standard crushing operations for desulfurizing and reducing the mineral matter of the coal so processed. The effectiveness of the separation is even further enhanced if available techniques are used to crush the coal to even smaller particle sizes, such as sizes less than about 10 microns in diameter, since such particles would then be smaller than the 10–12 micron diameter of the constituent cell size of the original plant material.

While in the foregoing, we have disclosed an embodiment of the invention in considerable detail for purposes of illustration, it will be understood by those skilled in the art that many of these details may be varied without departing from the spirit and scope of the invention.

We claim:

1. A method for separating finely-divided particles of similar size but different densities, comprising the steps of continuously introducing a stream of an aqueous slurry of said finely-divided particles having different densities into an inlet at the lower end of a centrifuge chamber while said chamber is rotating about a vertical axis; said chamber having upper and lower frusto-conical surfaces arranged with the apexes at the reduced ends of such frusto-conical surfaces meeting along an annular horizontal apex line disposed along a plane intermediate the upper and lower ends of said chamber; imparting rotational action to said stream as it passes through said inlet; controlling the rotational and inflow rates of said stream so that a first fraction of slurry particles having densities below a selected density will follow trajectories leading towards the frusto-conical surface above said apex line and whereas a second fraction of particles having densities greater than said selected density will follow trajectories leading to said frusto-conical surface below said apex line; and continuously withdrawing said lighter and heavier fractions from said chamber while said centrifuge is in operation.

2. The method of claim 1 in which said withdrawing step comprises withdrawing the first fraction from the upper end of said chamber and the second fraction from the lower end of said chamber.

3. The method of claim 1 in which said finely-divided particles are composed of coal and its impurities, and said selected density is selected from the range of about 1.4 to 2.0.

4. The method of claim 3 in which said selected density falls within the range of 1.5 to 1.7.

5. The method of claim 1 in which said particles are of a size range smaller than about 100 microns in diameter.

6. A method for separating pyrites and other relatively heavy impurities from coal, comprising the steps of continuously introducing a stream of an aqueous slurry of finely-divided particles of coal and impurities having different specific gravities into an inlet at the lower end of a centrifuge chamber while said chamber is rotating about a vertical axis; said chamber having upper and lower frusto-conical surfaces arranged with their apexes meeting along an annular horizontal apex line; imparting rotational action to said stream as it passes through said inlet so that the rotational rate of said stream substantially matches that of said chamber; controlling the rotational rate of said chamber and stream and the inflow rate of said stream so that a first fraction of slurry particles having specific gravities below a selected specific gravity within the range of about 1.4 to 2.0 will follow trajectories leading toward the frusto-conical surface above said apex line, whereas a second fraction of slurry particles having specific gravities greater than said selected specific gravity will follow trajectories leading to said frusto-conical surface below said apex line; continuing rotation of said chamber to cause the lighter and heavier fractions above and below said apex line to travel upwardly and downwardly along the respective frusto-conical surfaces under the influence of centrifugal force; and continuously withdrawing said lighter and heavier fractions from said chamber while said centrifuge is in operation.

7. The method of claim 6 in which said selected specific gravity falls within the range of 1.5 to 1.7.

8. The method of claim 6 in which said withdrawing step comprises withdrawing said first fraction from the upper end of said chamber and said second fraction from the lower end of said chamber.

9. The method of claim 6 in which said particles are of a size smaller than about 100 microns.

10. The method of claim 9 in which said particles are smaller than about 74 microns in diameter.

11. A centrifuge for continuously separating a suspension of particles of a range of densities into fractions above and below a selected intermediate density level, comprising a centrifuge rotor adapted to be rotated about a vertical axis and defining a chamber therein, said rotor having a side wall providing upper and lower inner surfaces of frusto-conical configuration arranged with their apexes meeting along an annular horizontal line; said rotor also having upper and lower end walls; means supporting said rotor for rotation about a vertical axis of centrifugation; drive means for rotating said rotor at a predetermined rate of rotation about said axis; inlet means provided by said lower end wall along said axis for continuously introducing said suspension upwardly into said chamber; means for controlling the rate of flow of said suspension into said chamber through said inlet means; means within said chamber for rotating suspension entering through said inlet means at a rate substantially matching the rotational rate of said rotor, whereby particles having a density below a selected level will follow trajectories from said inlet means leading to said upper frusto-conical surface, and particles below said density level will follow trajectories leading to said lower frusto-conical surface.

12. The centrifuge of claim 11 in which means are provided for continuously withdrawing suspensions containing fractions of different particle densities from the upper and lower ends of said chamber.

13. The centrifuge of claim 12 in which said means for continuously withdrawing suspensions containing fractions of different particle density includes an annular series of openings provided by each of said upper and lower end walls immediately adjacent said frusto-conical upper and lower surfaces, respectively, and stationary collection chambers provided adjacent said upper and lower end walls for collecting effluent discharged through said annular series of openings.

14. The centrifuge of claim 13 in which the opening of said annular series provided in said upper end wall are farther from said vertical axis than the openings of said series in said lower end wall.

15. The centrifuge of claim 11 in which said means for rotating said suspension comprises a plurality of radially-extending vanes leading from said axis to the inner surface of said rotor, said vanes being disposed in said chamber adjacent said inlet means.

16. The centrifuge of claim 15 in which said vanes are disposed entirely below said horizontal annular line.

17. The centrifuge of claim 11 in which said annular horizontal line is positioned closer to said lower end wall than to said upper end wall.

* * * * *